US006475040B1

(12) United States Patent
Myer et al.

(10) Patent No.: US 6,475,040 B1
(45) Date of Patent: Nov. 5, 2002

(54) ELECTRICAL CONTACT RECEPTACLE TO MATE WITH ROUND AND RECTANGULAR PINS

(75) Inventors: John Mark Myer, Millersville, PA (US); John Raymond Shuey, Mechanicsburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/577,168

(22) Filed: May 24, 2000

Related U.S. Application Data

(60) Provisional application No. 60/136,719, filed on May 28, 1999.

(51) Int. Cl.[7] ..... H01R 13/11
(52) U.S. Cl. ..... 439/852; 439/374
(58) Field of Search ..... 439/850, 851, 439/852, 853, 854, 374

(56) References Cited

U.S. PATENT DOCUMENTS

| | | | | | |
|---|---|---|---|---|---|
| RE27,463 | E | | 8/1972 | Sitzler et al. | 339/59 R |
| 3,781,760 | A | | 12/1973 | Mancini et al. | 339/59 M |
| 3,786,401 | A | * | 1/1974 | Jones et al. | 43/852 |
| 3,836,947 | A | | 9/1974 | Yeager | 339/259 R |
| 4,076,369 | A | * | 2/1978 | Ostapovitch | 439/852 |
| 5,188,545 | A | | 2/1993 | Hass et al. | 439/851 |
| 5,217,382 | A | | 6/1993 | Sparks | 439/161 |
| 5,259,796 | A | * | 11/1993 | Yamada et al. | 439/843 |
| 5,281,175 | A | | 1/1994 | Chupak et al. | 439/839 |
| 5,433,629 | A | | 7/1995 | Yagi et al. | 439/843 |
| 5,540,603 | A | * | 7/1996 | Fujiwara | 439/851 |
| 5,735,717 | A | | 4/1998 | Nabeshima | 439/851 |
| 5,897,405 | A | * | 4/1999 | Endo | 439/852 |
| 6,086,434 | A | * | 7/2000 | Rollero et al. | 439/852 |

FOREIGN PATENT DOCUMENTS

| | | | |
|---|---|---|---|
| DE | 44 10 951 A1 | 12/1994 | H01R/13/18 |
| EP | 0 701 299 A2 | 3/1996 | H01R/13/11 |
| EP | 0 727 843 A2 | 8/1996 | H01R/13/18 |
| JP | 54-102590 | 8/1979 | H01R/13/12 |
| WO | WO 98/18181 | 4/1998 | H01R/13/115 |

OTHER PUBLICATIONS

International Search Report, International Application No. PCT/US 00/14198, International Filing Date, May 24, 2000.
UM Application No. H03–97428, (Laid–Open No. H05–48271).

* cited by examiner

*Primary Examiner*—Gary F. Paumen
*Assistant Examiner*—James R. Harvey

(57) ABSTRACT

The electrical receptacle according to this invention is stamped and formed from a flat blank and has an upper wall, a first side wall extending from the upper wall,a lower wall extending from the first side wall, and a second side wall extending from the lower wall, wherein the first and second side walls are opposed, and adjacent walls are joined by radiused sections, wherein the electrical receptacle also includes a spring beam extending from the upper wall such that edges of the spring beam are spaced from adjacent side walls, and wherein each side wall includes an inwardly formed section or radiused rib to position a male terminal inserted into the electrical receptacle in alignment with the spring beam.

9 Claims, 8 Drawing Sheets

ELECTRICAL CONTACT RECEPTACLE TO MATE WITH ROUND AND RECTANGULAR PINS

CROSS REFERENCE TO CO-PENDING PROVISIONAL PATENT APPLICATION

This Application claims the benefit of Provisional Patent Application Ser. No. 60/136,719 filed on May 28, 1999.

BACKGROUND OF THE INVENTION

1. Field of the Invention

This invention relates to electrical connectors and electrical connector female terminals that can mate with male terminals having either round or rectangular cross sections. This invention also relates to stamped and formed electrical terminals that use a spring beam that is deflected upon engagement with either the round or rectangular male terminal to generate a normal force contact.

2. Description of the Prior Art

Mating electrical terminals typically employ mating female and male terminals. In many connectors the female connector comprises a-receptacle terminals that is stamped and formed from a spring metal blank. These stamped and formed receptacle terminals typically employ a deflectable spring to establish a normal force contact with the male terminal. These springs can be in the form of cantilever beams extending from one wall of the receptacle terminals or formed beams that are joined to the terminal wall on both ends.

The male terminal can also be stamped and formed, although typically the male terminal will not be a resilient member. In many applications a solid pin is used. These solid pins or blades can have a rectangular or square cross section or they can have a round cross section. Indeed some round pins are simply sections of a round wire. Even though the diameter of the round pins is equal to the thickness of the flat pin or blade, the same receptacle terminal may not be suitable for use with both rectangular and round pins. One problem is that the round pin can shift or roll laterally relative to the spring beam, and may not always remain in contact with the flat contact section of the receptacle spring.

SUMMARY OF THE INVENTION

The electrical receptacle terminal according to the invention depicted herein can establish a normal force contact with either a first male terminal having a rectangular cross section or a second male terminal having a circular cross section. The receptacle terminal has a spring member extending from a first receptacle wall. The spring member is deflectable upon engagement with either a first male terminal or a second male terminal to generate a normal force acting upon the male terminal in engagement therewith. Ribs extend inwardly from opposed receptacle side walls to position the male contact in engagement with the spring member in alignment with the spring member.

The electrical receptacle is stamped and formed from a flat blank. The receptacle has an upper wall, a first side wall extending from the upper wall, a lower wall extending from the first side wall, and a second side wall extending from the lower wall. The first and second side walls are opposed, and adjacent walls are joined by radiused sections. The electrical receptacle also includes a spring beam extending from the upper wall. Edges of the spring beam are spaced from adjacent side walls. Each side wall includes an inwardly formed section to position a male terminal inserted into the electrical receptacle in alignment with the spring beam.

The electrical receptacle terminal comprises a female terminal that can be used in an electrical connector assembly to mate with a round pin. The receptacle terminal includes a cantilever spring beam with a contact area on the cantilever spring beam in engagement with the round pin. The receptacle terminal includes walls extending beside the cantilever spring beam with sections protruding inwardly from the walls. the axial centerline of the round pin is kept in alignment with the contact area on the cantilever spring beams by these inwardly protruding sections

DETAILED DESCRIPTION OF THE PREFERRED EMBODIMENTS

FIGS. 1–18 depict an electrical connector and a contact that is suitable for use in making contact with a square or rectangular pin or blade terminal. The instant invention shown in the remainder of the views shows an electrical receptacle contact that can be substituted for the receptacle contact shown in FIGS. 1–18 that will make a reliable electrical contact with a round pin having the same diameter as the thickness of the square or rectangular pin with which the embodiment of FIGS. 1–18 is used. The embodiment of FIGS. 19–25 will also make a reliable contact with a square or rectangular pin in addition to contacting the round pin. Since the receptacle contact shown in FIGS. 19–25 is substitutable for the contact shown in FIGS. 1–18, a complete description of that contact and the connector with which it is used is included herein. The connector and contact disclosed in FIGS. 1–18 is also disclosed in U.S. patent application Ser. No. 09/077,814 filed Jun. 4, 1998, which is incorporated herein by reference. The receptacle contact terminal 102 of the alternate embodiment of FIGS. 19–25 can be substituted for the female terminals of FIGS. 1–12 in the housing shown in FIGS. 13–18. The receptacle contact terminals 102 can also be mounted in housings such as that shown in U.S. Pat. No. 6,100,340, which is incorporated herein by reference.

Figure 1:
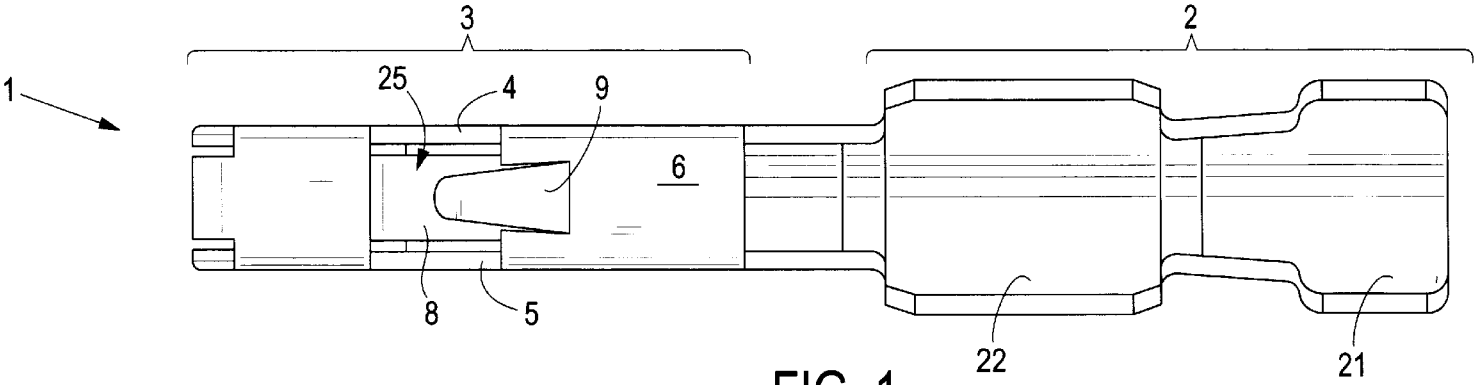
FIG. 1 PRIOR ART
FIG. 1 shows a plan view of an electrical contact.
Figure 3:
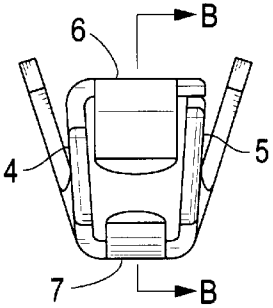
FIG. 3 PRIOR ART
FIG. 3 shows a view of the front end of the electrical contact.

FIG. 1 illustrates a plan view of a contact 1 according to the invention. The contact comprises a conductor connection region 2 and a contact-making region 3. The conductor connection region 2 serves for connection to an electrical conductor wire and has two crimp regions, an insulation crimp 21 and a crimp 22 for the electrical conductor wire. The contact-making region 3 serves to make contact with a complementary contact pin, the contact pin being introduced into the contact-making region from the front end of the latter. As can be seen particularly clearly in FIG. 3, which illustrates a view from the front end of the contact, the contact-making region is essentially designed in the form of a box. This box is not rectangular but rather trapezoidal in its cross-section. As can be seen in FIG. 3, the contact-making region 3 has two side walls 4 and 5, a top wall 6 and a bottom wall 7. The bottom wall 7 is in this case designed to be narrower than the top wall 6, thereby achieving the trapezoidal appearance. The two side walls 4 and 5 are therefore arranged such that they are inclined with respect to the top wall and with respect to the bottom wall 7, and they also run in a manner inclined with respect to one another.

Figure 2:
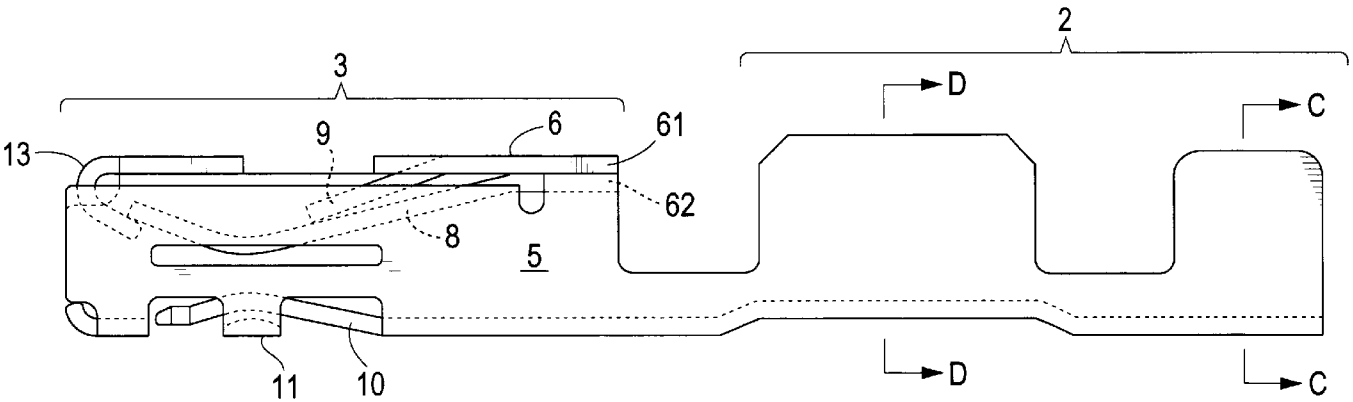
FIG. 2 PRIOR ART
FIG. 2 shows a side view of an electrical contact.
Figure 7:
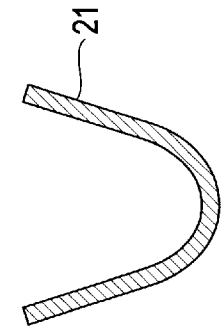
FIG. 7 PRIOR ART
FIG. 7 shows a section through the insulation crimp.
Figure 6:
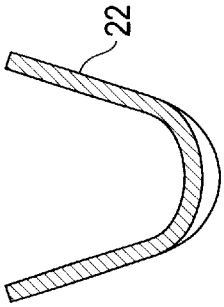
FIG. 6 PRIOR ART
FIG. 6 shows a section through the conductor crimp.
Figure 4:
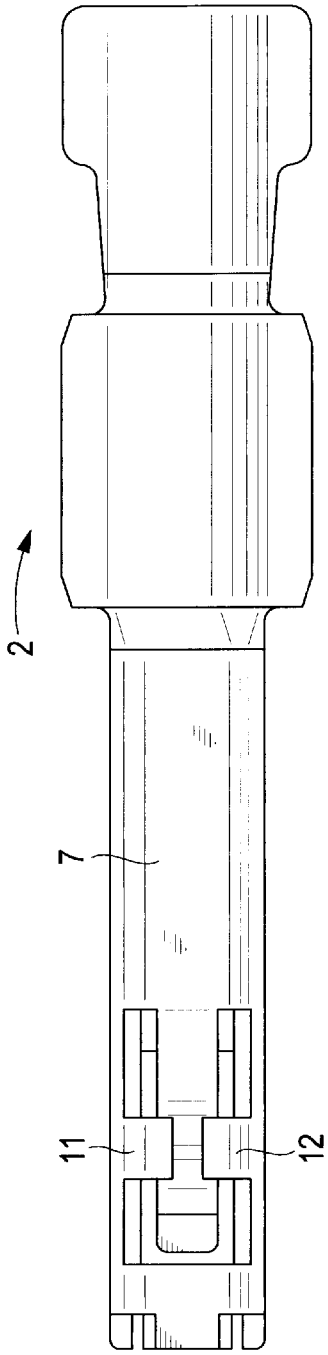
FIG. 4 PRIOR ART
FIG. 4 shows a view from below of the electrical contact.
Figure 5:
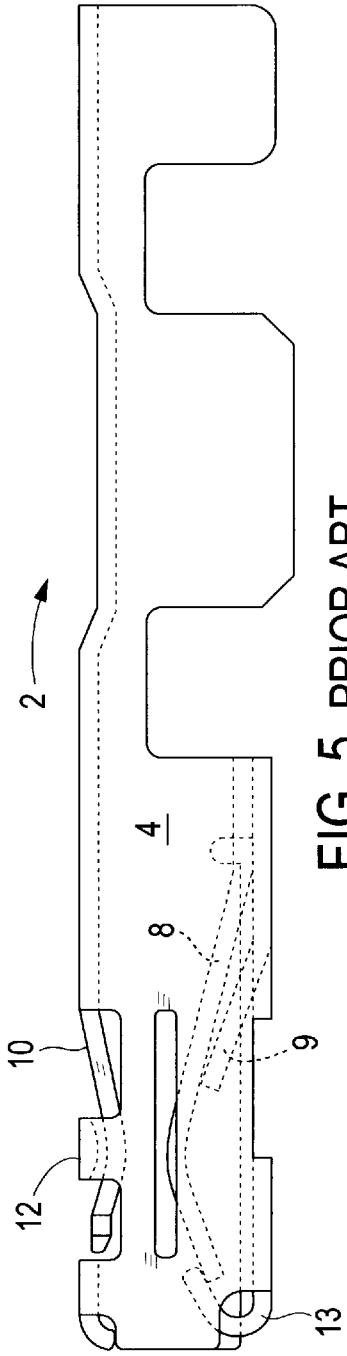
FIG. 5 PRIOR ART
FIG. 5 shows a second side view of the electrical contact.

FIG. 1 provides a view of the top wall 6, it also being possible to see the side walls 4 and 5. FIG. 2 shows a view of the side wall 5, and FIG. 5 shows a view of the side wall 4. In both illustrations, the contact spring arm 8 is illustrated by dashed lines. The contact spring has a free end at the front end of the electrical contact I and is connected to the top wall 6 in the direction of the conductor connection region 2. As is evident from FIG. 2, the top wall comprises two layers 61 and 62 in the region near to the conductor connection region 2. The supporting spring arm 9, which is both shown by dashed lines in the illustrations 2 and 5 and can also be seen in FIG. 1, is bent away from the upper layer 61. The supporting spring 9 supports the contact spring arm 8, which starts out from the lower layer 62 of the top wall 6. Furthermore, the compensating leaf spring 10 can be seen in the figures. This is a spring which is cut free at one end and extends away from the conductor connection region. The spring is bent inwards, and two stops 11 and 12 (see FIG. 4) start out from the bottom wall 7 and prevent the spring from overstretching. FIGS. 6 and 7 illustrate the sections along the section lines B and D through the two crimp regions. A lug 13 extends forwards from the top wall 6 and is bent inwards into the contact-making region 3. This lug serves as an insertion funnel for the insertion of a complementary contact pin or contact blade.

Figure 8:
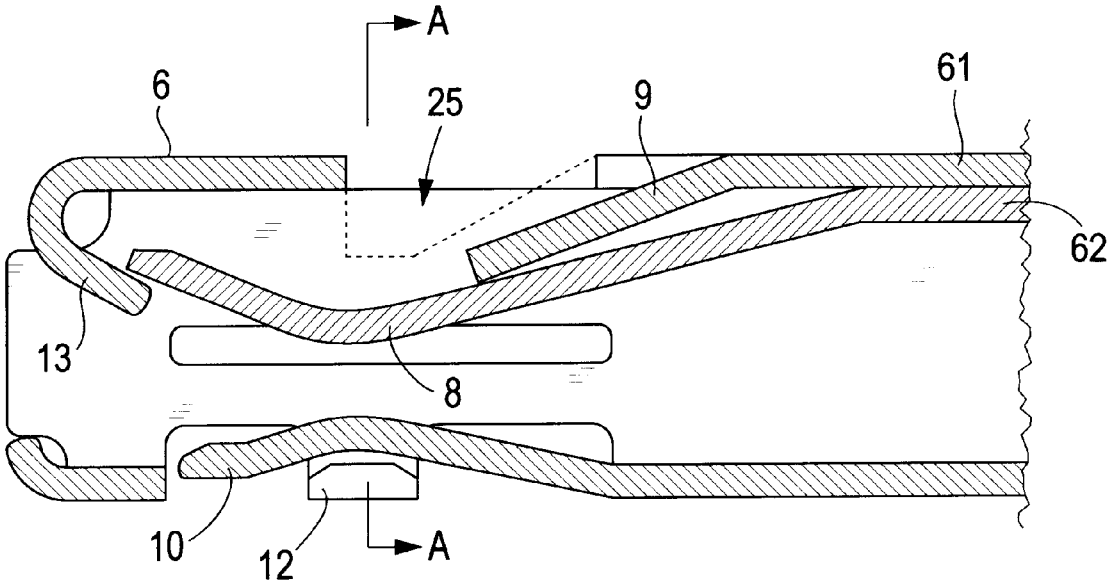
FIG. 8 PRIOR ART
FIG. 8 shows a section along the section line BB according to FIG. 3.

FIG. 8 illustrates a section through the electrical contact 1 along the section line BB according to FIG. 3. The top wall 6 with the two layers 61 and 62 can be seen particularly clearly in this illustration. The arrangement of contact spring arm 8 and supporting spring arm 9, as well as compensating leaf spring 10 and stop 12, also becomes clear here. In the exemplary embodiment illustrated, the contact spring arm 8 is not prestressed, that is to say the lug 13 serves exclusively for forming an insertion funnel. However, it is possible to achieve prestressing of the contact spring arm 8. The lug 13 then likewise serves as a stop for the prestressed contact spring arm 8. The section illustrated also shows the opening 25, in which a latching means (illustrated by dashed lines) can engage in order to hold the contact in a chamber.

Figure 9:
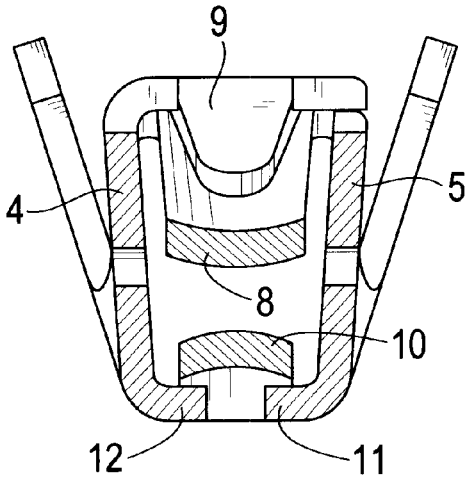
FIG. 9 PRIOR ART
FIG. 9 shows a section along the section line AA according to FIG. 8.

The cross-sectionally trapezoidal contact-making region can be seen clearly once again in FIG. 9, which illustrates a section along the line AA through FIG. 8. The side walls 4 and 5 run in a manner inclined with respect to one another. The compensating leaf spring 10 is situated above the stops 11 and 12 inside the contact-making region. The contact spring arm 8 is supported by the supporting spring arm 9. The contact spring arm 8 is bent in the contact-making region, as illustrated in FIG. 9. This bending extends over the entire length of the contact spring arm 8 in order to increase the stiffness.

Figure 10:
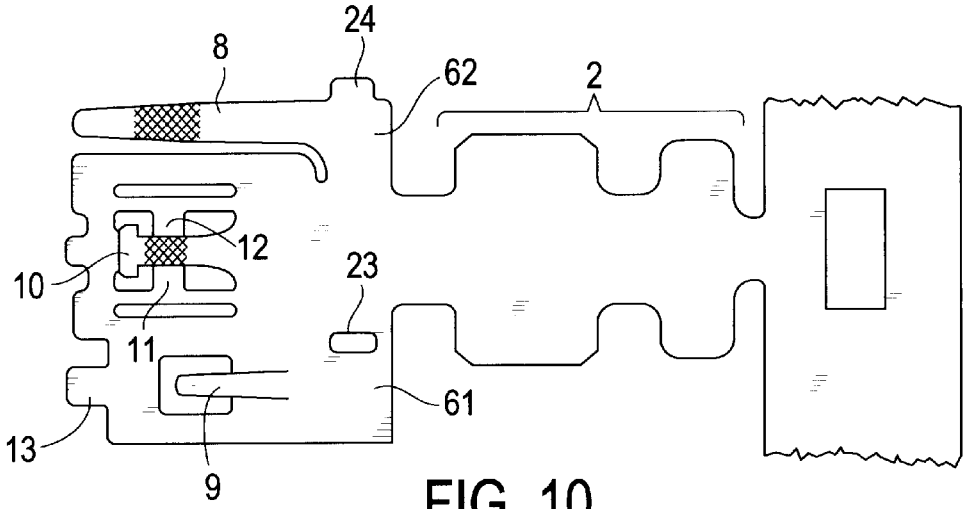
FIG. 10 PRIOR ART
FIG. 10 shows a plan view of the layout of a contact which has been stamped out but not yet folded.

The layout of the contact according to the invention can be seen clearly in FIG. 10. The contact-making region 3 is formed by folding a number of times, the top wall being formed from two layers 61 and 62. The contact spring arm 8 is formed from the layer 62, while the supporting spring arm 9 and the lug 13 are formed from the layer 61. The stops 11 and 12 as well as the compensating leaf spring 10 are formed from the bottom wall 7. An opening 23 and a corresponding lug 24, which secures the lower layer of the wall 61 to the side wall, can be seen from the layout. The cross-hatched regions on the contact spring arm 8 and the compensating leaf spring 10 represent those regions of the contact which are gold-plated for the purpose of better contact-making.

Figure 11:
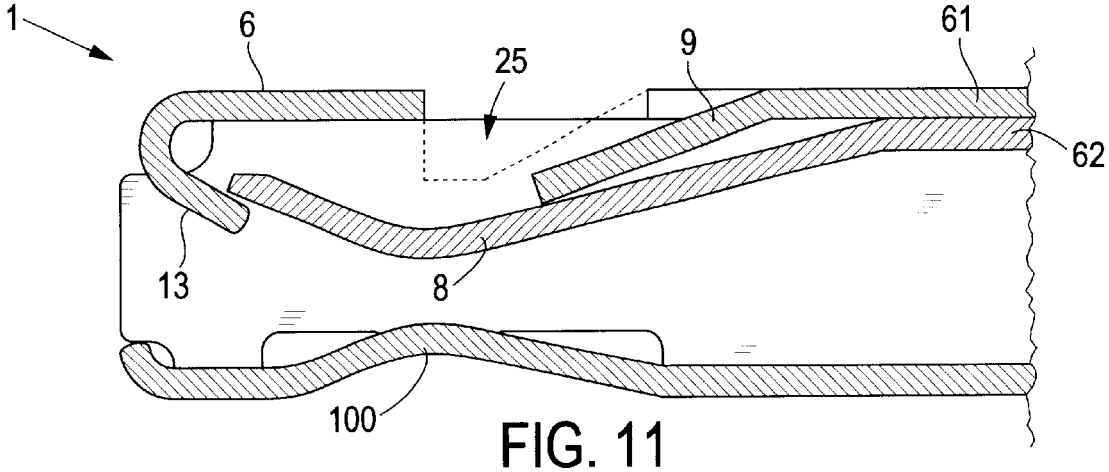
FIG. 11 PRIOR ART
FIG. 11 shows a longitudinal section through a slightly modified contact.
Figure 12:
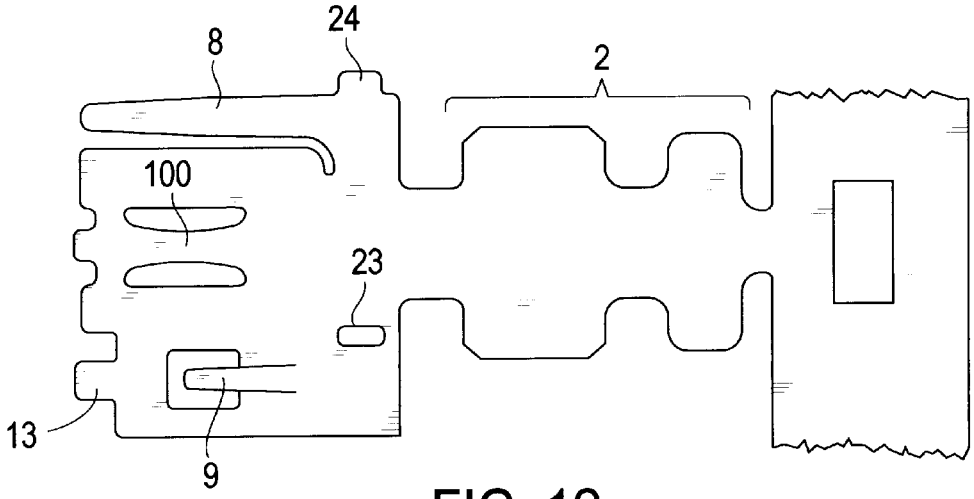
FIG. 12 PRIOR ART
FIG. 12 shows a layout of the slightly modified contact.
Figure 13:
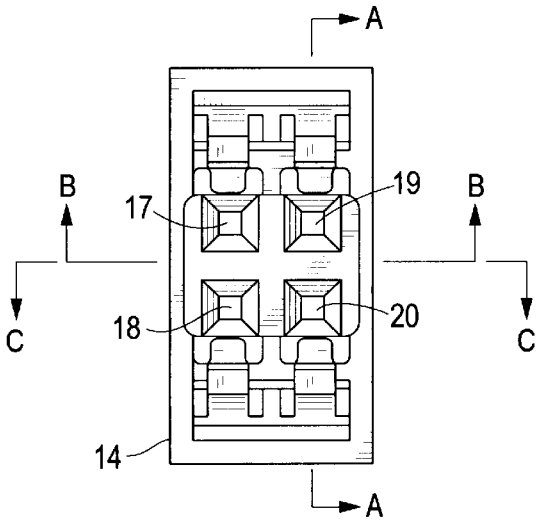
FIG. 13 PRIOR ART
FIG. 13 shows a view of the plug-in face end of a housing.

FIG. 11 illustrates a longitudinal section (as in FIG. 8) through a further version of a contact and FIG. 12 illustrates a corresponding layout. These differ from the contact illustrated in FIGS. 8 and 10 in terms of the different compensating spring. The compensating leaf spring 100 illustrated is joined at both ends and cut free only on the sides. Its deflection is thereby limited and stops are not provided.

FIGS. 13 to 18 then illustrate a housing which is suitable for accommodating a contact according to the invention. The housing 14 has four contact chambers 17 to 20. The contact chambers each extend from the cable end of the housing 14 as far as the plug-in face end of the housing, where openings are provided for the introduction of complementary contact pins.

Figure 16:
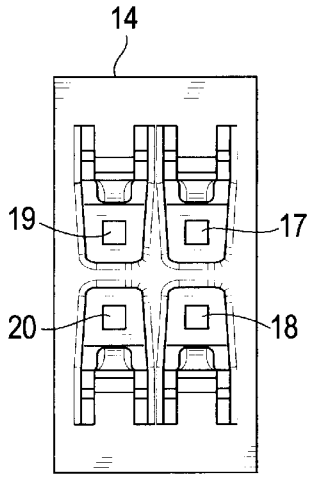
FIG. 16 PRIOR ART
FIG. 16 shows a view of a housing from the cable end.
Figure 14:
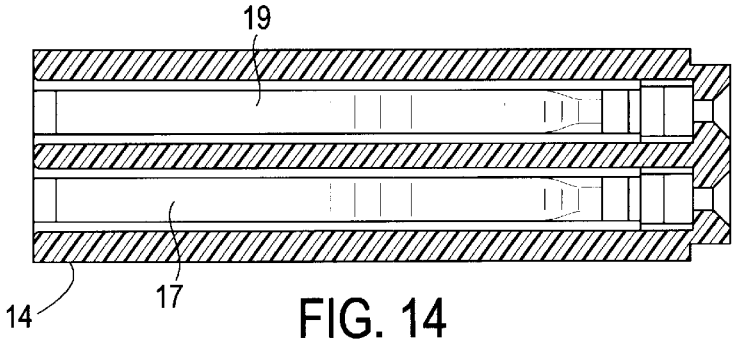
FIG. 14 PRIOR ART
FIG. 14 shows a section along the section line BB according to FIG. 13.

As emerges particularly clearly from FIG. 16, the view from the cable end of the housing, the chamber walls between the individual chambers 17 to 20 are very thin. As a result of the inventive form of the contacts, namely their trapezoidal cross-section, it is possible for the width of the chamber walls to change over the layer thereof and, as a result, for a robust region to be produced at least on one side. This enables the contacts, or the contact chambers, to be arranged as close to one another as possible.

Figure 15:
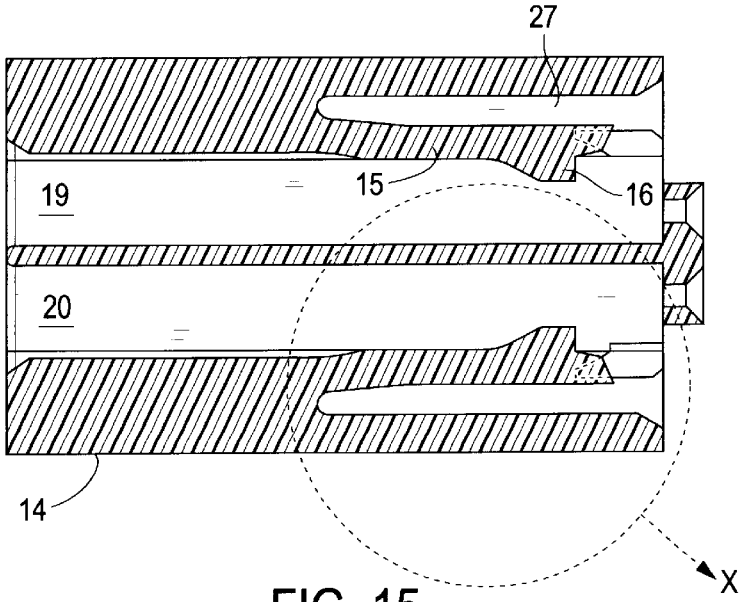
FIG. 15 PRIOR ART
FIG. 15 shows a section along the section line AA according to FIG. 13.
Figure 17:
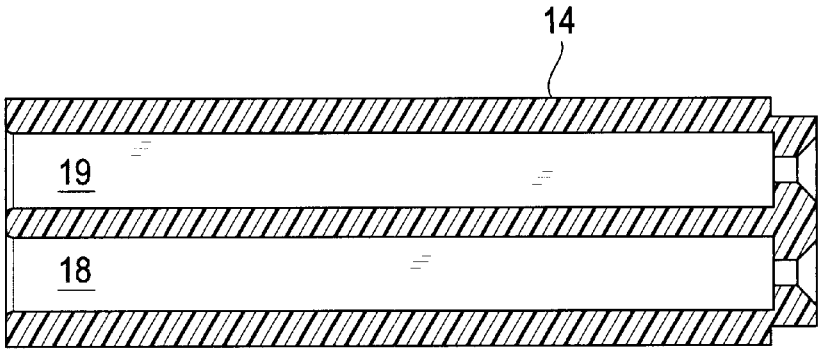
FIG. 17 PRIOR ART
FIG. 17 shows a section along the section line CC according to FIG. 13.

From FIG. 15, it is evident that each contact chamber is assigned a flexible arm 15 having a latching lug 16 which engages in the contact chamber. When the contact is introduced, the latching lug 16 enters an opening 25 in the top wall 6 of the contact (see FIG. 1 or 8) and secures the contact in the chamber.

Figure 18:
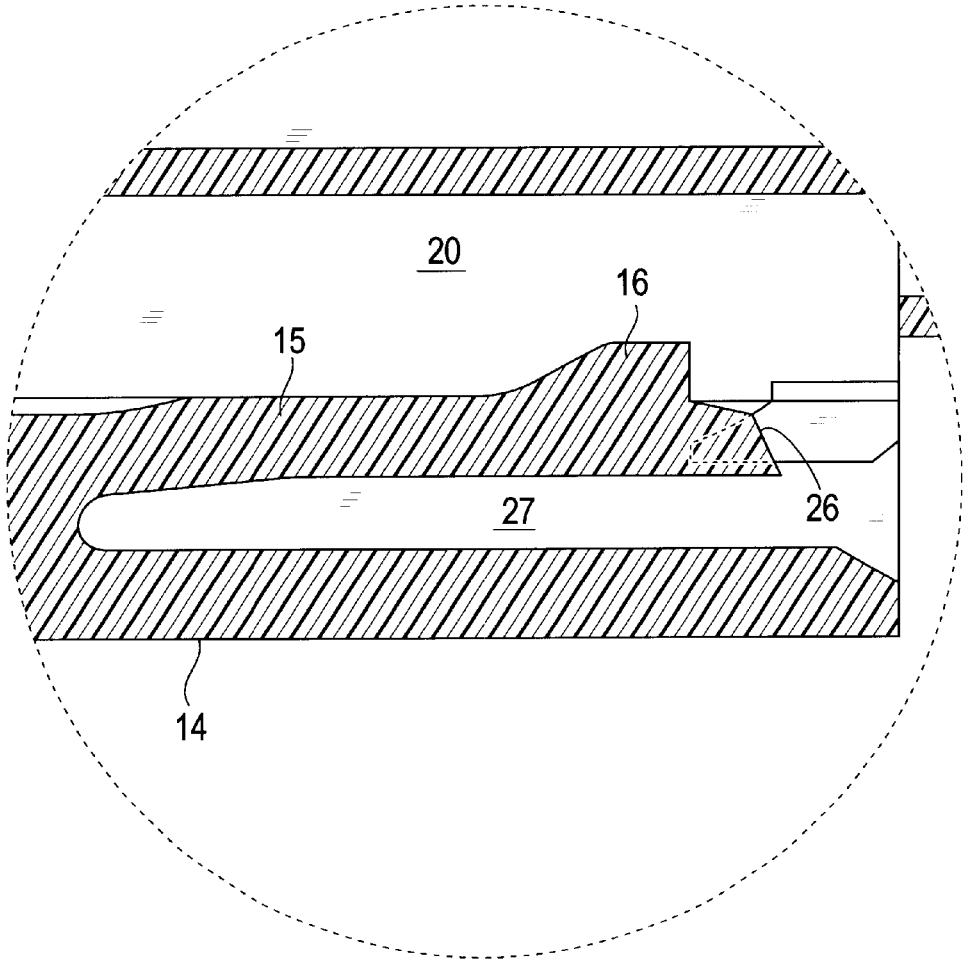
FIG. 18 PRIOR ART
FIG. 18 shows a detailed view of the detail X according to FIG. 15.
Figure 19:
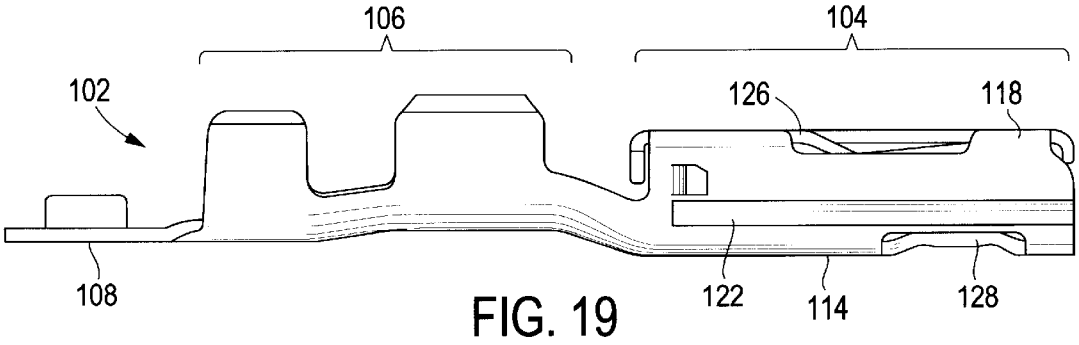
FIG. 19 is a side view of an alternate embodiment of the receptacle terminal.
Figure 20:
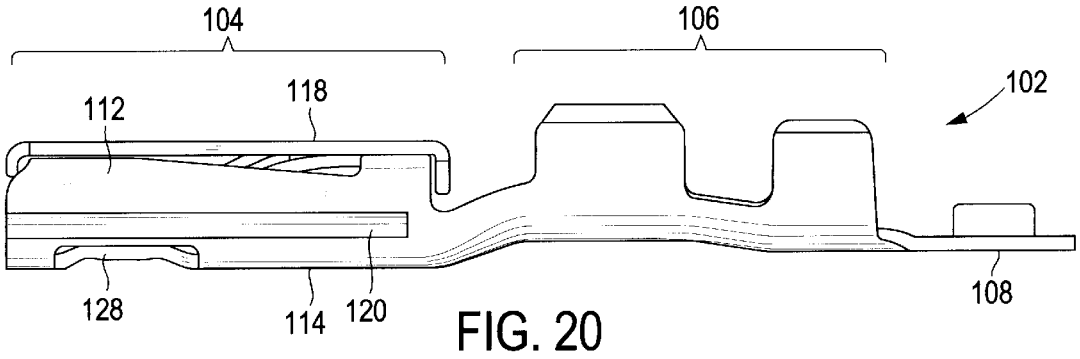
FIG. 20 is a view of the side opposite that shown in FIG. 19 of the alternate embodiment of the receptacle terminal.

The flexible arm 15 is illustrated once again, in detail, in FIG. 18. It can be seen here that the end face 26 of the flexible arm is bevelled. This bevelling serves the following purpose: if a contact is introduced incompletely into the contact chamber, the flexible contact arm 15 is bent outwards, that is to say out of the contact chamber. If an attempt is made in this state to connect a complementary connector to the illustrated connector, then a wall region of the complementary connector, which normally engages in the depression 27 (see FIG. 18), runs up against the oblique end face 26 of the flexible arm. The special configuration of the end face prevents the flexible arm from being pressed back into its original position by the wall region of the complementary connector even though the contact is incorrectly introduced. What is effected by this is that the flexible arm 15 is moved even further out of the chamber.

The alternate embodiment of the receptacle contact terminal 102 shown in FIGS. 19–25 is stamped and formed from a flat blank. The contours or the edges of the contact receptacle structures are first stamped in the flat blank of spring metal, such as a copper alloy. The flat stamped blank is then formed along bend lines to form the final structure. Receptacle terminal 102 has a mating or contact section 104 that has a box shape having walls that will surround a male terminal, such as a pin or blade, when inserted into contact section 104. In the alternate embodiment, the cross section of the contact section 104 has a substantially trapezoidal shape of the type illustrated by the embodiment of FIGS. 1–18. The receptacle terminal 102 also includes a crimp section 106 for attaching the terminal to a wire. It should be understood that other equivalent means may be provided to attach a receptacle terminal 102 to an external conductor. For example an insulation displacement contact section or a solder section could be used. The mating section 104, to be subsequently described in more detail, could also be used on a printed circuit board receptacle terminal. Multiple stamped and formed receptacle terminals 102 are connected by a carrier strip 108 in a conventional manner.

Figure 21:
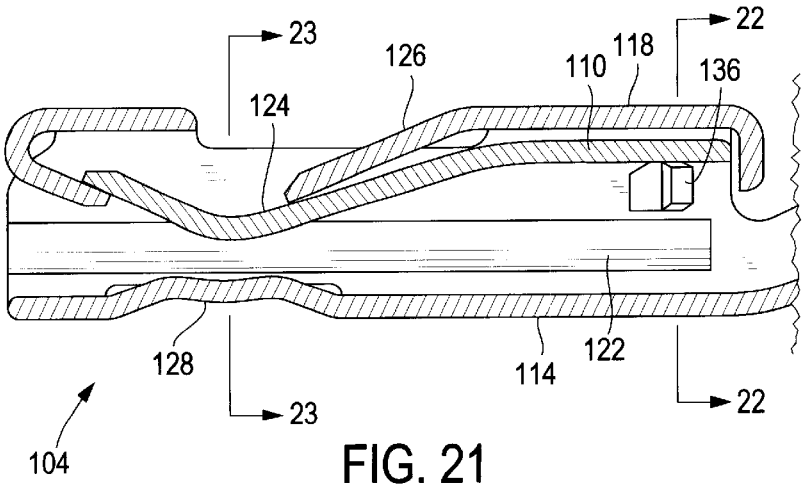
FIG. 21 is a section view of the mating portion of the alternate embodiment of the receptacle terminal shown in FIGS. 19 and 20.
Figure 22:
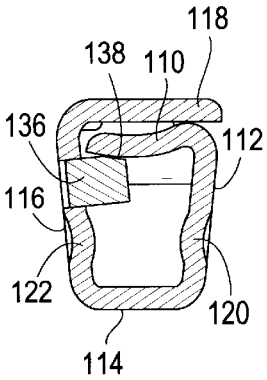
FIG. 22 is a cross section taken along section lines 22 in FIG. 21 of the mating portion of the alternate embodiment of the receptacle terminal.

The receptacle terminal mating section 104 is formed by folding sections of the flat blank into a configuration having five wall sections. These wall sections are shown in FIGS. 21 and 22. A first upper wall section 110 is joined to a first side wall 112 by a radiused corner. The first side wall 112 is in turn joined to a lower wall 114 again with a radiused intermediate corner between the two adjacent wall sections. A second side wall 116 extends from the opposite radiused corner of the lower wall 114. The first side wall 112 is opposed to the second side wall 116, although the two side walls are mutually inclined in the trapezoidal mating section 104. The fifth wall 118 of the mating section 104 is joined to the second side wall 116 and is formed over the upper wall 110 so that this end wall section overlaps the upper wall 110.

A mating normal force contact is formed between the receptacle terminal 102 and a mating male terminal, or pin or blade, and is established by a spring beam 124 located in the contact mating section 104. In receptacle terminal 102, this spring beam 124 comprises a cantilever spring beam 124 which extends from the inner top wall 110 as best seen in FIG. 21. This tapered cantilever beam 124 has a wider base than tip resulting in generation of more contact force. A contact area, which is the closest portion of the beam 124 to the lower wall 114, is located adjacent to the narrower tip of the cantilever beam 124. As shown in FIG. 21 the end of the cantilever beam 124 engages a tab section at the front of the mating section 104 to preload the cantilever beam 124 in the same manner as for the embodiment of FIGS. 1–18. A helper spring 126 is formed from the overlapping top wall 118 and is positioned behind the main cantilever contact spring 124 as a back up. This helper spring 126 will increase the normal force contact established between the contact spring 124 and the male terminal inserted into mating section 104. Although the helper spring 126 is an effective means to increase the contact force, in some applications of this invention, such as where a noble metal plating is used, the helper spring 126 may be omitted. It should also be understood that in other embodiments, the spring beam 124 need not be a cantilever spring and could be joined at both ends to the wall from which the beam extends.

A tab 136 is struck inwardly from the side wall 116 adjacent the rear of the mating section 104. As seen in FIG. 21 and 22, this inwardly struck tab 136 supports a free edge of the inner top wall 110, from which the cantilever contacts beam 124 extends. Tab 136 has a chamfered upper edge 138 which engages a curved lower surface of the inner top wall 110 when the wall 110 is formed over into engagement with the tab 136. This tab 136 function to precisely position the wall 110 and to prevent the cantilever beam 124 from being tilted relative to a plane extending parallel to the lower wall 114. The cantilever spring beam 124, which can also be supported at its free end by the lip forming the entrance to the mating section 104, will thus be properly oriented relative to either a round or rectangular male pin inserted into the receptacle mating section 104. The cantilever beam 124 thus will not be canted relative to a mating male terminal. If the cantilever beam 124 is canted or tilted relative to the mating male terminal, the contact area between the two terminals will be smaller, resulting in a higher localized contact force, and excessive wear at the mating interface.

The mating section 104 also has a lower support surface 128 formed upward from the lower wall 114. When a male terminal is inserted into the mating section 104, contact will be established with the male terminal by both the contact area on the main cantilever spring 124 and the lower support surface 128 and the male terminal will be aligned between these two contact surfaces.

Figure 23:
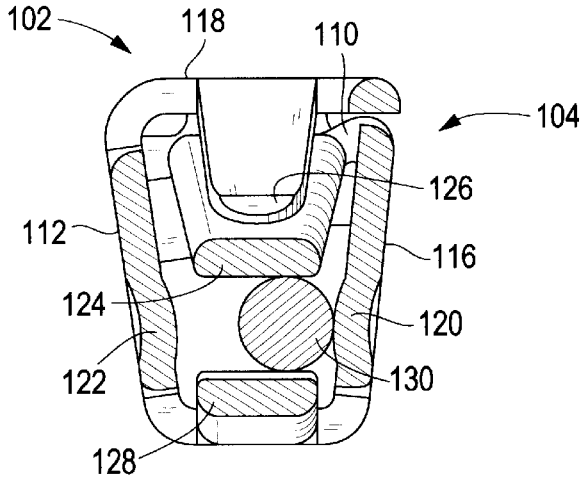
FIG. 23 is a cross section view showing the alternate receptacle terminal in engagement with a round pin.
Figure 24:
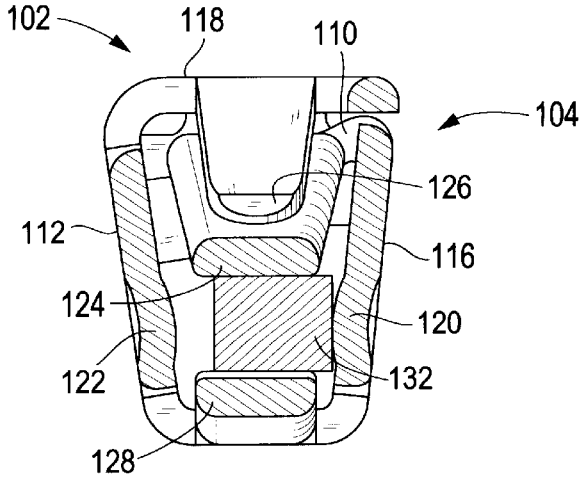
FIG. 24 is a cross section view showing the alternate receptacle terminal in engagement with a rectangular pin with a thickness equal to the diameter of the round pin shown in FIG. 23.
Figure 25:
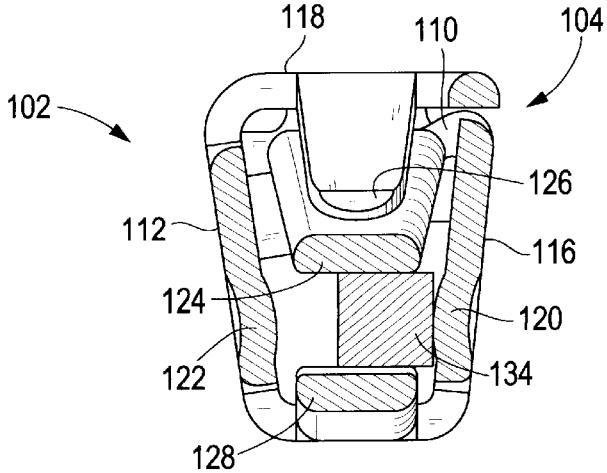
FIG. 25 is a cross section view showing the alternate receptacle terminal in engagement with a square pin with a thickness equal to the diameter of the round pin shown in FIG. 23.

The width of the lower wall 114 is less then the width of the upper wall 110 so that the two side walls 112 and 116 are inclined and converge with increasing distance form the upper wall 110. Each side wall also has an inwardly extending section formed adjacent the lower wall 114. Inwardly extending rib 120 is formed in side wall 112, and rib 122 is formed in side wall 116. Each of these ribs 120, 122 extends from the front of the mating section 104 to its rear. These ribs 120, 122 will thus have a length that is sufficient to extend along substantially the entire length of a mating male terminal inserted into the mating section 104. The ribs 120, 122 are radiused inwardly and are formed by punching the initially flat side wall section. In this embodiment, the ribs 120, 122 are joined to the corresponding side wall along both the upper and lower edges, although as shown in FIGS. 23–25, this rib can be separated from the corresponding side wall along either the top or bottom edge of the rib. Ribs 120, 122 are formed in a position such that the ribs will be aligned with the sides of a male terminal inserted into the mating section 104 between the contact area of the cantilever spring beam 124 and the lower support surface 128.

The inwardly formed and radiused ribs 120 and 122 function to permit the receptacle terminal 102 with a cantilever beam spring 124 to be used with a round pin in addition to a rectangular or square pin or with a blade. FIG. 23 shows the use of receptacle terminal 102 having inwardly formed and radiused ribs 120, 122 with a round pin 130. Note that the edges of the cantilever beam spring 124 are spaced from the side walls 112 and 116. This spacing is due to practical consideration inherent in a stamped and formed contact. First, the bend line between oblique walls must be radiused to prevent fracturing or stress concentrations. Second, there must be sufficient material between the base of the beam and the edges of the wall 112 from which it is formed to withstand sufficient stress to generate a normal force contact between the cantilever beam 124 and the round contact pin 130. However, a round contact pin 130 could move laterally when contact by the spring 124 into, or at least partially into, the gap between either side wall 112 or 116. Lateral movement of the round pin out of alignment with the spring beam 124 can result in a defective contact and lower normal force applied at the contact area to the round pin 130. The inwardly radiused ribs 120 and 122 function to prevent excessive lateral movement of the round pin 130 out of alignment with the contact area of the spring beam 124 and the lower support surface 128. Since the radiused ribs 120, 122 extend over substantially the entire length of the mating section 104 they can engage a male terminal, such as round pin 130 substantially over the entire portion of that pin, which extends into the mating section 104. Note that in FIG. 23, the axial centerline of the round pin 130 remains beneath the flat contact areas on the spring beam 124 and the support surface 128, even when the lateral offset of the round pin 130 is at its greatest. FIGS. 24 and 25 show the use of the same receptacle contact 102 with rectangular pins 132 or with square pins 134 that have a thickness that is equal to the diameter of the round pin 130. In the examples shown herein the round pin 130 has a diameter of 0.64 mm. and the thickness of the rectangular pins 132 and square pins 134 is also 0.64 mm., a standard dimension for terminals of this type. Of course the same approach could be use with male and female terminals having different dimensions.

It should be understood that the embodiment depicted herein comprises a representative embodiment of this invention. One of ordinary skill in the art could of course substitute equivalent structures for the representative elements depicted herein. For example, the raduised ribs 120, 122 could be replaced by a series of embossments or dimples that would engage a round pin at multiple axial locations, and this modification would still function to achieve the same functions of preventing the round pin from shifting laterally out of engagement with the box receptacle contact surfaces. Therefore the invention is to be defined by the following claims and not by the representative embodiment depicted herein.

What is claimed is:

1. An electrical receptacle terminal comprising:

a) a crimp section structured to receive and crimp a wire conductor therein;

b) a receptacle section positioned immediately forward of and adjacent to said crimping section, the receptacle section having a cavity therein structured to receive male terminals having a rectangular cross-section and male terminals having a circular cross-section;

c) said cavity defined by a bottom wall, a top wall, and a pair of opposing side walls, said side walls being connected to both said top and bottom walls,said top wall having a spring member extending therefrom, said spring member being deflectable upon engagement with a male terminal to generate a normal force acting upon the male terminal in engagement therewith, regardless of whether the male terminal has a circular cross-section configuration or a rectangular cross-section configuration;

d) each said side wall of said receptacle section having a fixed linearrib member oriented along a longitudinal axis of the receptacle section, and extending substantially the entire length of said cavity, said rib members projecting inwardly from said side walls toward an interior of said receptacle section to position a male terminal in alignment with and in engagement with the spring member and to support the male terminal along substantially all of that portion of the male terminal received within the cavity of the receptacle terminal.

2. The electrical receptacle terminal of claim 1 wherein the opposed side walls extend transverse to the first receptacle wall.

3. The electrical receptacle terminal of claim 1 wherein the opposed side walls and the first receptacle wall comprise folded sections of an initially flat blank.

4. The electrical receptacle terminal of claim 3 wherein only one of the opposed side walls is joined directly to the first receptacle wall.

5. The electrical receptacle terminal of claim 4 wherein a second side wall extends from an overlapping receptacle wall that extends over the first receptacle wall.

6. The electrical receptacle terminal of claim 1 wherein the inwardly extending ribs comprise arcuately formed sections of the opposed side walls.

7. The electrical receptacle terminal of claim 6 wherein the ribs are joined to the side wall from which each extends, both above and below the rib.

8. The electrical receptacle terminal of claim 6 wherein one edge of each rib is separated from the side wall from which the rib extends.

9. The electrical receptacle terminal of claim 1 having a trapezoidal cross section in which the opposed side walls converge with distance from the first receptacle wall and the spring member is a tapered member.

* * * * *